US011015342B2

(12) United States Patent
Timenes

(10) Patent No.: US 11,015,342 B2
(45) Date of Patent: May 25, 2021

(54) MOVABLE WALL ELEMENT AND MOVABLE WALL SYSTEM

(71) Applicant: WHEEL.ME AS, Oslo (NO)

(72) Inventor: Atle Timenes, Snarøya (NO)

(73) Assignee: WHEEL.ME AS, Oslo (NO)

( * ) Notice: Subject to any disclaimer, the term of this patent is extended or adjusted under 35 U.S.C. 154(b) by 0 days.

(21) Appl. No.: 16/312,763

(22) PCT Filed: Jun. 21, 2017

(86) PCT No.: PCT/EP2017/065168
§ 371 (c)(1),
(2) Date: Dec. 21, 2018

(87) PCT Pub. No.: WO2017/220628
PCT Pub. Date: Dec. 28, 2017

(65) Prior Publication Data

US 2019/0169843 A1 Jun. 6, 2019

(30) Foreign Application Priority Data

Jun. 22, 2016 (EP) ..... 16175775

(51) Int. Cl.
*E04B 1/36* (2006.01)
*E04B 2/74* (2006.01)
(Continued)

(52) U.S. Cl.
CPC ..... *E04B 2/827* (2013.01); *E04B 1/36* (2013.01); *E04B 1/34357* (2013.01);
(Continued)

(58) Field of Classification Search
CPC ..... E06B 9/64; E06B 9/56; E06B 9/66; E06B 9/68; B60R 5/045; B60R 5/048;
(Continued)

(56) References Cited

U.S. PATENT DOCUMENTS 5,890,868 A * 4/1999 Comardo ..... B01J 8/002 414/160
8,857,496 B2 10/2014 Raniere
(Continued)

FOREIGN PATENT DOCUMENTS

CN 2118762 10/1992
CN 101091033 12/2007
(Continued)

OTHER PUBLICATIONS

International Search Report dated Sep. 12, 2017 in International (PCT) Application No. PCT/EP2017/065168.
(Continued)

*Primary Examiner* — Phi D A
(74) *Attorney, Agent, or Firm* — Wenderoth, Lind & Ponack, L.L.P.

(57) ABSTRACT

A movable wall element for a building with a floor and a ceiling is disclosed, where the movable wall element comprises at least one lower roller device comprising a wheel element which is capable of engaging the floor of the building when the wall element is to be moved across the floor. The movable wall element further comprises at least one upper roller device comprising a wheel element which is capable of engaging the ceiling of the building when the wall element is to be moved across the floor.

20 Claims, 8 Drawing Sheets

(51) Int. Cl.
*E04B 2/82* (2006.01)
*E06B 9/64* (2006.01)
*E04B 1/343* (2006.01)

(52) U.S. Cl.
CPC ..... *E04B 1/34363* (2013.01); *E04B 2/74* (2013.01); *E04B 2/82* (2013.01); *E06B 9/64* (2013.01)

(58) Field of Classification Search
CPC ..... E04B 1/34368; E04B 1/34357; E04B 1/34363; E04B 1/36; E04B 2/74; E04B 2/82
See application file for complete search history.

(56) References Cited

U.S. PATENT DOCUMENTS

2002/0153745 A1* 10/2002 Messano ..... B60P 3/34 296/156
2005/0086876 A1 4/2005 Clark
2009/0090475 A1* 4/2009 Raniere ..... E04B 2/7431 160/351
2010/0132895 A1 6/2010 Logue
2011/0097878 A1* 4/2011 Olgado ..... C23C 16/4587 438/478
2012/0037323 A1* 2/2012 Laraway ..... E06B 3/94 160/188
2012/0220176 A1* 8/2012 Neprud ..... B60F 3/00 440/12.52
2012/0227914 A1* 9/2012 Coleman ..... E05F 15/605 160/188
2012/0305201 A1* 12/2012 Goodman ..... E05D 15/063 160/127
2014/0138035 A1* 5/2014 Potter ..... E04F 11/1851 160/135
2014/0224433 A1* 8/2014 Goodman ..... E05D 15/0643 160/127
2015/0013922 A1* 1/2015 Pegrum ..... E04B 2/7422 160/351
2016/0186566 A1* 6/2016 Stanford ..... B61B 13/02 414/528

FOREIGN PATENT DOCUMENTS

DE 201 09 671 11/2002
EP 1 437 468 7/2004
FR 1 550 222 12/1968
JP 09-195626 7/1997
JP 10-37589 2/1998
JP 2002-038639 2/2002
JP 2002-201745 7/2002
WO 2014/144368 9/2014
WO 2015/118492 8/2015

OTHER PUBLICATIONS

English Translation of Search Report dated Apr. 9, 2020 in Chinese Patent Application No. 2017800513841.

* cited by examiner

MOVABLE WALL ELEMENT AND MOVABLE WALL SYSTEM

BACKGROUND OF THE INVENTION

1. Field of the Invention

The present invention relates to a movable wall element for room partitioning in a building.

2. Description of the Related Art

Known wall elements that are moveable are usually moving on some sort of track or are restricted to move along some sort of guide elements that severely limit the positions that the wall element can be moved to. Known wall elements that are movable, but not restricted to move along a track or a guide element, are usually provided with wheels that roll against the floor. These wall elements are manually moved and some also have a locking mechanism which is manually operated through intricate mechanical systems within the wall elements. Such wall elements are known from DE 2405027 A1 and U.S. Pat. No. 6,409,291 B1.

SUMMARY OF THE INVENTION

The objective of the present invention has been to provide a wall element that can be freely moved from one position to another.

It has further been an objective of the present invention to enable the wall element to move without one or more persons pushing or pulling the wall.

It has also been an objective of the present invention to provide a wall element that can remain in a fixed position and move through a building without any kind of external support.

It has also been an objective of the present invention to provide a wall element that can be remotely operated and is capable of automatically moved into its correct position.

It has also been an objective of the present invention that the wall element is suitable for partitioning a building into separate rooms or offices.

A movable wall element according to the present invention comprises at least one, but preferably a plurality of upper roller devices and at least one, but preferably a plurality of lower roller devices where each roller device is provided with a wheel element that preferably is movably mounted within their respective roller devices. The wheels of the lower roller devices are capable of engaging the floor of the building where the wall element is located and the wheels of the upper roller devices are capable of engaging the ceiling of the building. The movable wheel elements are movable between a first position where the wheel elements are engaging the floor or the ceiling of the building, i.e. the wheel elements are in firm contact with the floor and ceiling, and a second position where the wheel elements are retracted and are not engaging the floor or the ceiling.

The wheel elements of both the lower roller devices and the upper roller devices engage the floor and the ceiling of the building respectively when the wall element is to be moved. The wall element is therefore capable of moving across the floor without support from any person or any other support devices without falling over.

To reduce the chance of the wheel elements of the upper and lower roller devices slipping, the wheel elements are preferably covered with or made of a friction enhancing material such as a rubber material.

The wall element is preferably also provided with at least one, but preferably a plurality of locking members which are capable of engaging with the floor and the ceiling of building. The upper roller devices and/or the lower roller devices may be provided with such locking members or the wall element may be provided with separate locking devices each having a movable locking member that is capable of engaging the floor or the ceiling of the building, i.e. the locking members are in firm contact with the floor and/or ceiling. The locking members are preferably made of or covered with a friction enhancing material, such as a rubber material, in order to prevent the locking members from slipping when they are engaging the floor and/or ceiling.

The lower roller devices and/or the upper roller devices are preferably provided with one or more motors, preferably electric or electromagnetic motors, one of which is used to drive the wheel elements. The wall elements can thereby move across the floor, within the building, all by itself without any support from a person or any other support device.

The lower roller devices and/or upper roller devices preferably have essentially the same construction. The roller devices preferably comprise a cylinder housing and a piston which is movably mounted within the cylinder between a first position and a second position. A motor, preferably an electric or electromagnetic motor, provides the power to move the piston within the cylinder. A wheel element is rotatably arranged in the piston or mounted to the piston. The wheel element is preferably a spherical wheel element, but may also be a wheel that is rotatable about both a vertical axis and a horizontal axis.

The locking members, whether they are included in the roller devices or are provided in separate locking devices, are adapted to co-operate with the wheel elements of the upper roller devices and the lower wheel elements in a way such that at least either the wheel elements of the lower roller devices or locking members are always engaging the floor and such that at least either the wheel elements of the upper roller devices or locking members are always engaging the ceiling. Thereby, any slipping of the wall element against the floor or the ceiling is avoided.

The roller devices and the locking devices are preferably provided with a control unit and one or preferably a plurality of sensors which are signally connected to the control unit. Preferably, at least one sensor of the sensors is capable of registering a wireless signal. The wheel elements are preferably provided with one or more sensors that registers the speed and direction of rotation of the wheel elements. Furthermore, the roller devices, or possibly the wall element itself, can be provided with one or more sensors, such as gyro sensors, that registers the position of the wall element, for example whether the wall element is in a vertical position or not. The control unit receives instructions from a sender device, for example to prepare the wall element for movement by putting the wheel elements in their first position where they engage the ceiling and the floor, and putting the locking elements in their second positions where they are not engaging the ceiling and the floor. Further instructions from the sender device may include the position to which the wall element should move, the speed that the wall element should move with etc. The sender devices can typically be a smartphone or smartpad, a conventional remote control etc. or it may simply be a person activating the wall system by talking to it. Smartphones and smartpads and similar devices may be provided with an app that a person can use to control the movement of the wall element, or a system of two or more wall elements where some or all of the wall elements may be connected to at least one other wall element.

Hence, there is provided a movable wall element for a building with a floor and a ceiling. The movable wall element comprises at least one lower roller device comprising a wheel element that is capable of engaging the floor of the building when the wall element is to be moved across the floor. The movable wall element further comprises at least one upper roller device comprising a wheel element which is capable of engaging the ceiling of the building when the wall element is to be moved across the floor. That the wheel elements are engaging the floor and the ceiling means that the wheel elements are in firm contact with the floor and the ceiling.

In an embodiment of the wall element, the wheel element of the lower roller devices may be arranged in a fixed position where the wheel elements are constantly engaging the floor such that the wall element is capable of rolling on the floor. In this embodiment, the weight of the wall element will be supported by the wheel elements at all times, also when the wall element is in its desired position.

The wheel elements of the upper roller devices and optionally also the lower roller devices as long as wheel elements are not arranged in a fixed position, are preferably movably arranged in the upper roller device and the lower roller device between a first position where the wheel elements are engaging respectively the ceiling and the floor of the building and a second position where the wheel elements are retracted and the wheel elements are not engaging the ceiling or the floor respectively.

Preferably, the upper roller devices and optionally the lower roller device, if the wheel elements are movably arranged in the lower roller device, all comprise at least one motor, preferably an electric or electromagnetic motor, which is adapted for moving respective wheel elements between their first and second positions.

The upper roller devices and/or the lower rollers devices may all further comprise a locking member which is movably arranged in the upper roller device and the lower roller device between a first position where the locking members are engaging respectively the ceiling and the floor of the building and a second position where the locking members are retracted and the locking members are not engaging the ceiling or the floor respectively.

The upper roller device and/or the lower roller device may further comprise an upper locking member and a lower locking member respectively, which are movably arranged in the upper roller device and the lower roller device between a first position where the locking members are engaging respectively the ceiling and the floor and a second position, where the locking members are retracted and the locking members are not engaging the ceiling or the floor respectively. That the locking members are engaging the floor and the ceiling means that the locking members are in firm contact with the floor and the ceiling.

The upper roller device and optionally the lower roller device, if the wheel elements are movably arranged in the lower roller device, preferably each comprises at least one motor, preferably an electric or electromagnetic motor, where the motor is adapted for moving the upper locking member and the lower locking member between their first and second positions.

The upper roller device and optionally the lower roller device, if the wheel elements are movably arranged in the lower roller device, each comprises a single motor, preferably an electric or electromagnetic motor, where the motor is adapted for moving both the upper and lower wheel elements and the upper and lower locking members between their respective first and second positions.

Alternatively, the upper roller device and the lower roller device may each comprise at least two motors, preferably two electric or electromagnetic motors, a piston motor that is adapted for moving the upper and lower wheel elements between their first and second positions and a locking member motor that is adapted for moving the locking members between their first and second positions.

Preferably, the upper roller device and the lower roller device each comprises at least one motor, preferably an electric or electromagnetic motor, which is adapted for driving the wheel elements of the upper roller device and lower roller device respectively. The wall element can thereby move by itself without help from one or more persons.

The wheel elements of the upper roller device and/or the lower roller device are preferably lockable in their respective first positions where the wheel elements are in engagement with the ceiling and the floor respectively.

The wheel elements and the locking members may be arranged in separate roller devices and locking devices. The wall element may then comprise at least one roller device, without a locking member, where the roller device comprises a wheel element for engagement with the ceiling and/or the floor, and the wheel element is movably arranged in the roller device between a first position where the wheel element is engaging the ceiling or the floor and a second position where the wheel element is retracted and the wheel element is not engaging the ceiling or the floor. The wall element may then also comprise at least one locking device, without a wheel element, where the locking device comprises a locking member for engagement with the ceiling and/or the floor, and the locking member is movably arranged in the locking device between a first position where the locking member is engaging the ceiling or the floor and a second retracted position where the locking member is not engaging the ceiling or the floor respectively.

The locking members of the upper roller device and/or the lower roller device and/or the locking device are preferably made, at least in part, of a material or covered with a material that provides friction between the locking members and the ceiling and the floor when the locking members are engaging the ceiling and the floor.

The at least one locking device further preferably comprises a motor, preferably an electric or electromagnetic motor, for movement of the locking member between the first and second positions.

The upper roller element and the lower roller element preferably each comprises a motor, preferably an electric or electromagnetic motor, which are adapted to drive the wheel elements of the upper roller element and the lower roller element respectively.

The movable wall element may comprise a connecting element for connection to a second movable wall element. The connecting element is preferably adapted for a rotational movement between the two movable wall elements. The connecting element may for example be of a hinge-type connecting element.

The upper roller device, the locking device if the wall element is provided with a locking device, and the lower roller device each preferably comprises a control unit for control of the movement of movable wheel elements and movable locking members between their respective first and second positions and/or for controlling the electric or electromagnetic motor that drives the wheel elements of the upper roller device and the lower roller device when the wall element is moving.

The upper roller device, the lower roller device, the roller device, if the wall element is provided with a separate roller device, and the locking device, if the wall element is provided with a separate locking device, all comprise a sensor and/or an antenna for receiving a wireless control signal, the sensor and/or antenna being signally connected to the control unit. The wireless signal may be transmitted from for example a remote control, a smartphone or a smart pad, a computer device, a joy stick device etc., or it may simply be a person activating and controlling the wall system by using his or her voice or by employing one or more particular movements with his or her body. The sensor/antenna for receiving a wireless control signal may be arranged in the housing of the roller device or the locking device, in the wall element or may be integrated in the control unit.

There is also provided a movable wall system comprising at least one movable wall element as described above and a sender device that is capable of sending a wireless control signal to the at least one movable wall element. The sender device may be a remote control, a smartphone or a smart pad, a computer device or a joy stick device, or it may simply be a person activating and controlling the wall system by using his or her voice or by employing one or more particular movements with his or her body.

BRIEF DESCRIPTION OF THE DRAWINGS

A non-limiting embodiment of the movable wall element will now be described in detail with reference to the drawings, where.

DETAILED DESCRIPTION OF THE INVENTION

Figure 1:
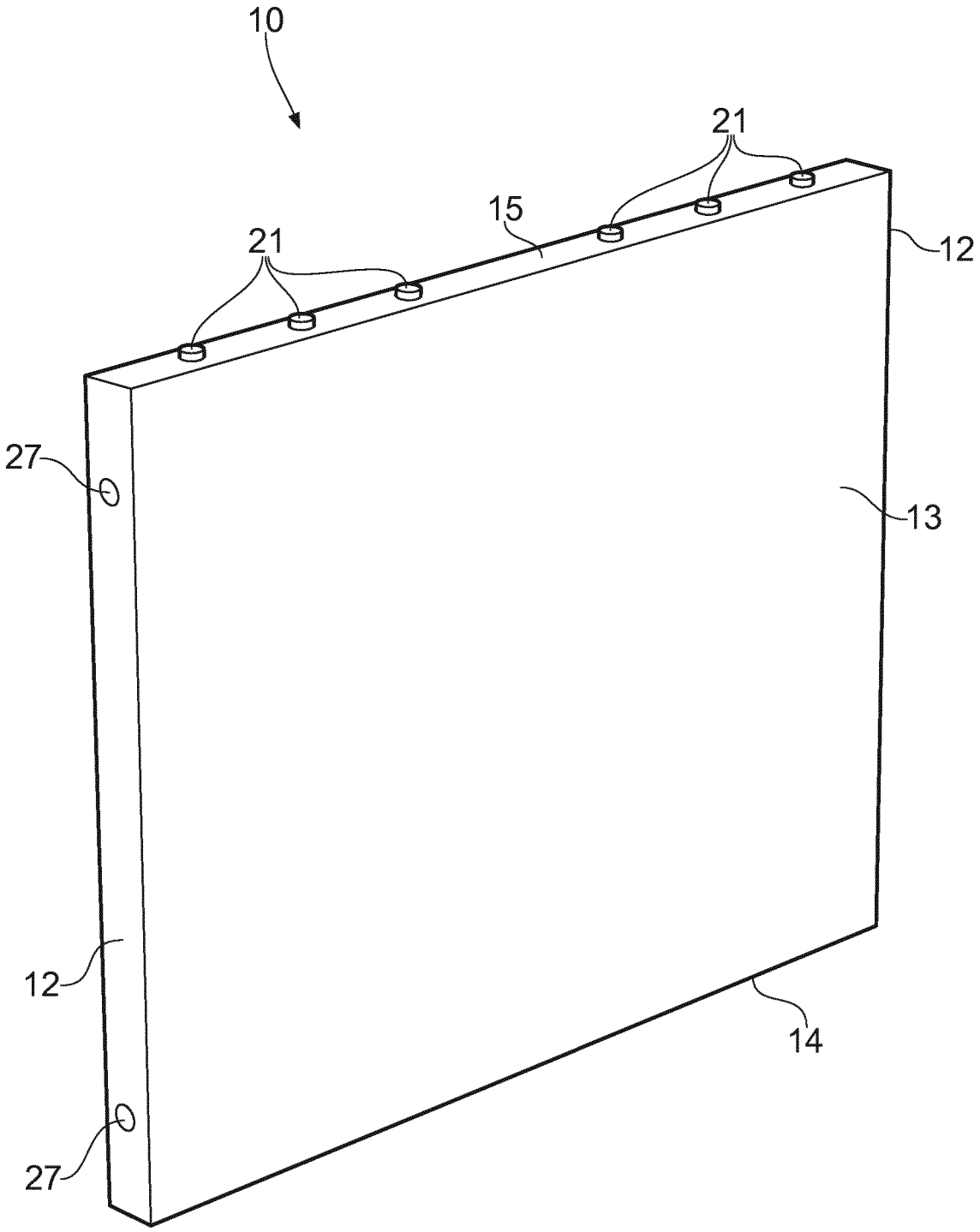
FIG. 1 shows perspective view a movable wall element with the upper locking member in its first position and the upper wheel element in its second position.
Figure 2:
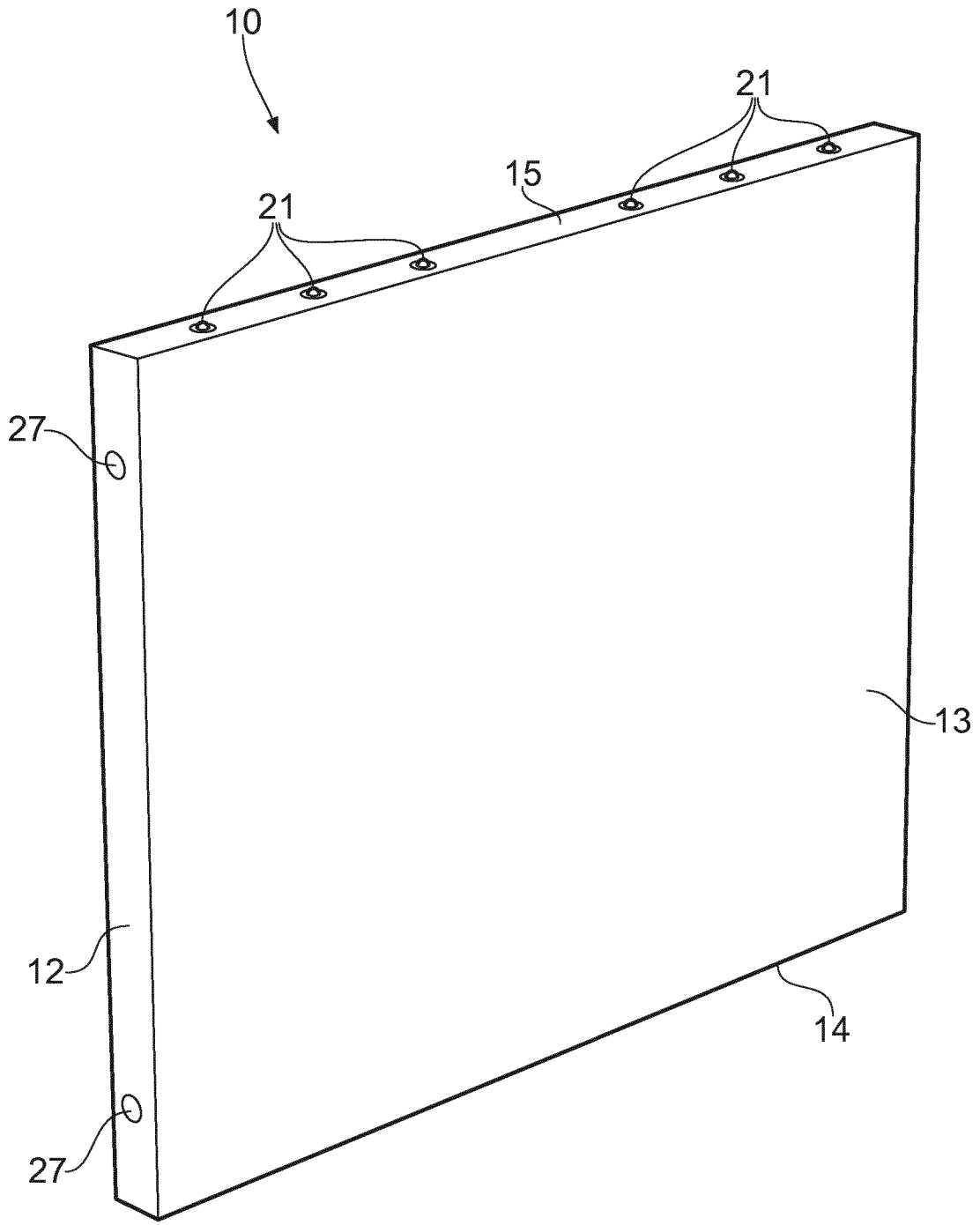
FIG. 2 shows perspective view a movable wall element with the upper wheel element in its first position and the upper locking member in its second position.

In FIGS. 1 and 2 a movable wall element 10 is shown having an upper side face 15 that will face the ceiling, a lower side face 14 that will face the floor, two first side faces 12 that will face another wall or the environment, and two large second side faces 13 that will face the environment.

The height of the wall element 10 is preferably adapted to the distance between the floor and the ceiling of the building in which the wall element will be placed such that there is a relatively small gap between the upper side face 15 of the wall element and the ceiling and between the lower side face 14 of the wall element and the floor. Typically the gap between the wall element and the ceiling and between the wall element and the floor will be a few millimeters and rarely more than one centimeter.

Alternatively, the wall element 10 may be provided with an adjustable height, for example by arranging a top part of the wall element telescopically in a lower part of the wall element. Thereby the wall element may be used in a building having different heights between floor and ceiling.

In the upper side face 15 there is provided at least one, but preferably a plurality of upper roller devices 21 and in the lower side face 14 there is provided at least one, but preferably a plurality of lower roller devices 17.

Each of the upper roller devices 21 shown in FIGS. 1 and 2 are provided with both an upper wheel element 22 and an upper locking member 23. Similarly, the lower roller devices 17 shown in FIGS. 1 and 2 are provided with both a lower wheel element 18 and a lower locking member 19. A more detailed, but schematic shown design of a roller device including both a wheel element and a locking device is shown in more detail in FIG. 7.

Figure 7:
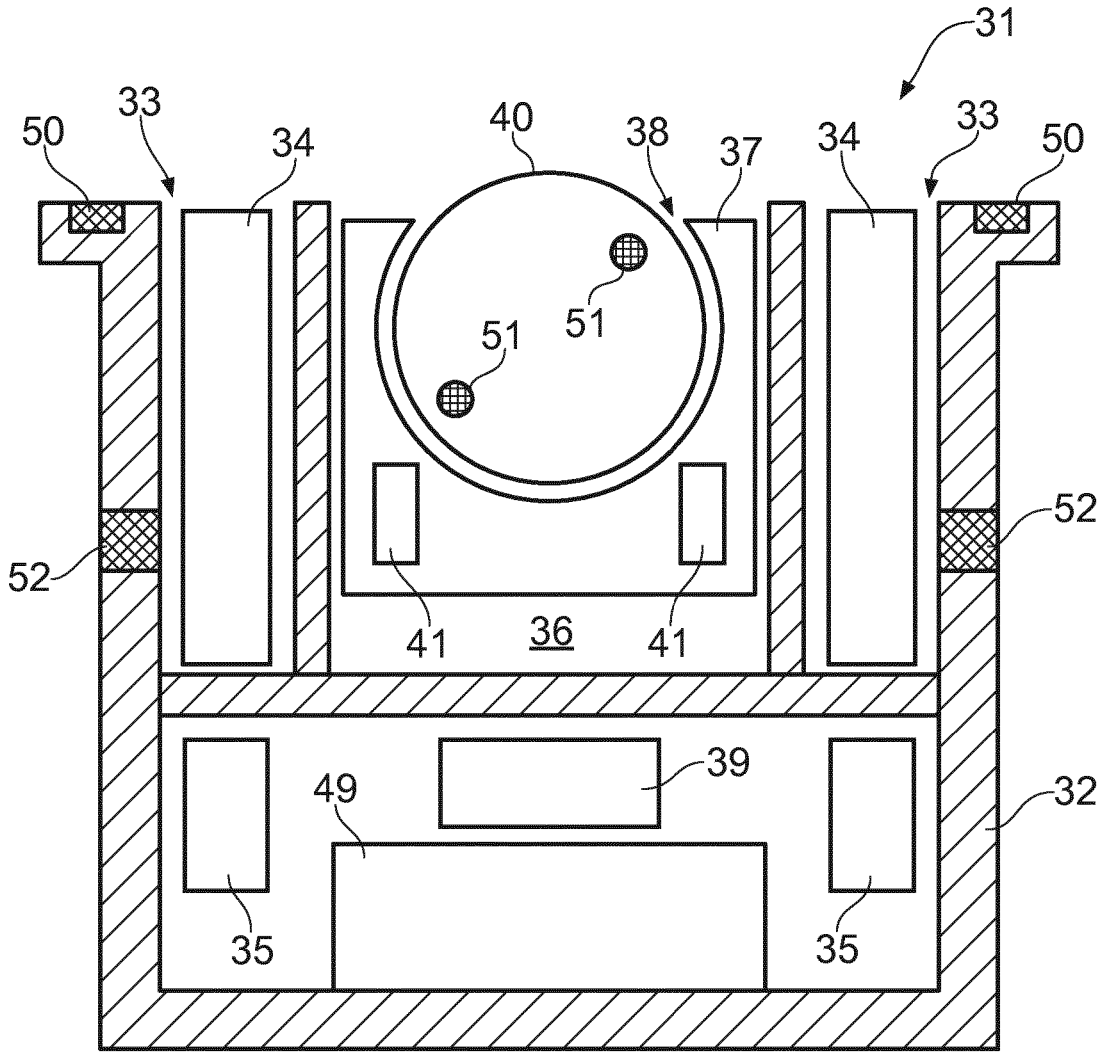
FIG. 7 illustrates a possible, general design of an upper or a lower roller device.

Referring to FIG. 7, a roller device 31 is shown, which can be an upper roller device 21 or a lower roller device 17, which has a housing 32. The housing is provided with an annular space 33 in which an annularly shaped locking member 34 is movably positioned. The locking member 34 is movable between a first position where the locking member extends out of the annular space 33 in the housing 32 making the locking member capable of engaging the ceiling or the floor of a building, and a second position (as shown in FIG. 7) where the locking member is retracted into the annular space 33 and incapable of engaging the ceiling or the floor. The roller device 32 is provided with one or more locking member motors 35, preferably an electric or electromagnetic motor, which are connected to or adapted to move the locking member 34 between its first position and second position.

The roller device shown in FIG. 7 further comprises a piston 37 which is movably arranged in a cylinder space 36 in the housing 32. The piston 37 is provided with a piston cavity 38 in which a spherical wheel element 40 is provided such that the wheel element 40 is capable of rotating relative to the piston 37. It should be noted that the illustration shown in FIG. 7 is very simplified and that only the principles are shown. For example, a plurality of small support balls will normally be provided between the wheel element 40 and the piston cavity 38 to enable the wheel element 40 to roll properly. A more detailed description of a roller device with a wheel element arranged in a piston, but without a locking member, can be found in a number of publications including WO 2015/118493 A1 and WO 2015/118492 A1, and will therefore not be described in further detail here.

The piston 37 is movable between a first position (as shown in FIG. 7) where the wheel element 40 extends out of the cylinder space 36 in the housing 32 making the wheel element 40 capable of engaging the ceiling or the floor of a building, and a second position where the wheel element 40 is retracted into the cylinder space 36 and incapable of engaging the ceiling or the floor. The roller device 32 is provided with at least one piston motor 39, preferably an electric or electromagnetic motor, which is connected to or adapted to move the piston 37 with the wheel element 40 between the first position and second position of the wheel element 40.

Figure 3:
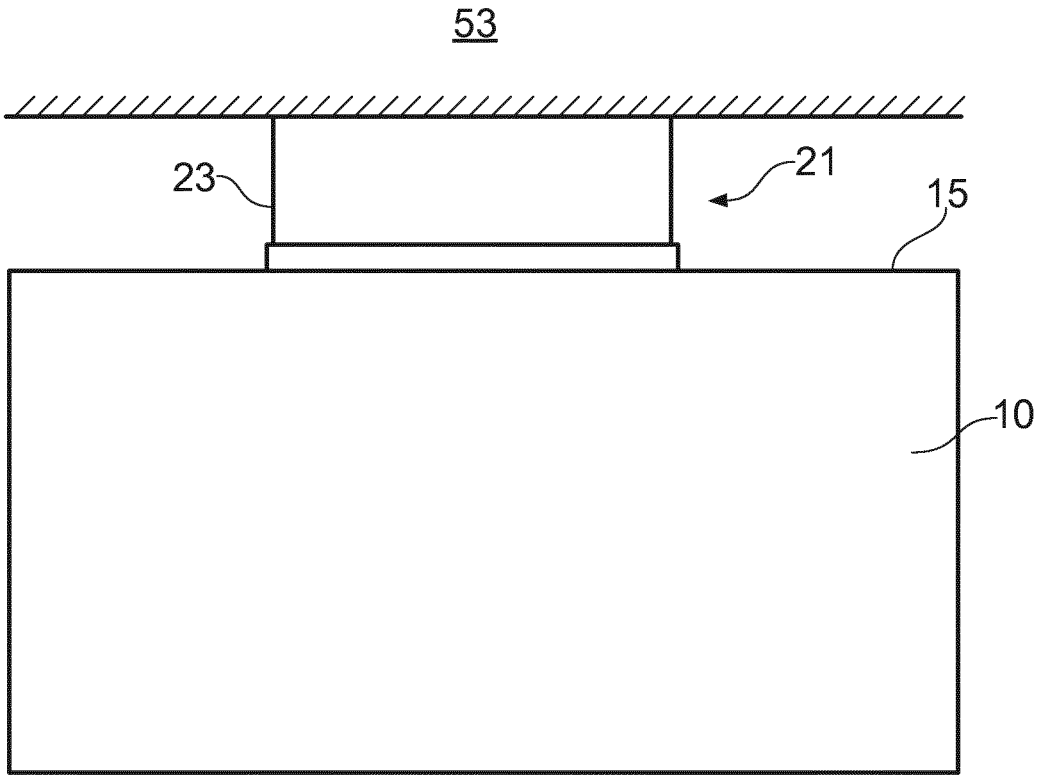
FIG. 3 shows an enlarged view of a portion of FIG. 1 where the upper locking member is engaging the ceiling of a building.

Now referring to FIG. 1, the upper locking members 23 of the upper roller devices 21 are in their first position, i.e. they will be engaging the ceiling of the building. While the wall element 10 is in a stationary position, the upper wheel elements 22 may be kept in their first positions engaging the ceiling or in their second position where the wheel elements are retracted and are not engaging the ceiling. The same will apply to the lower wheel element and the lower locking element of the lower roller devices 17. The upper locking members 23 and the lower locking members 19 are in firm contact with the ceiling and the floor respectively and the wall element 10 remains safely in its vertical position. In FIG. 3, an upper locking member 23 is shown in detail in the first position. The locking member 23 of the upper roller device 21 is extended and engages the ceiling 53.

To avoid the locking members 23, 19 of the upper roller devices 21 and the lower roller devices 17 respectively from slipping when the wall element 10 is placed in a stationary position in a room of the building, the locking members 23, 19 of the upper roller devices and the lower roller devices are preferably covered with, or made of, a material that provides friction between the locking members and the ceiling and the floor. Typically such a material can be a rubber material.

Figure 4:
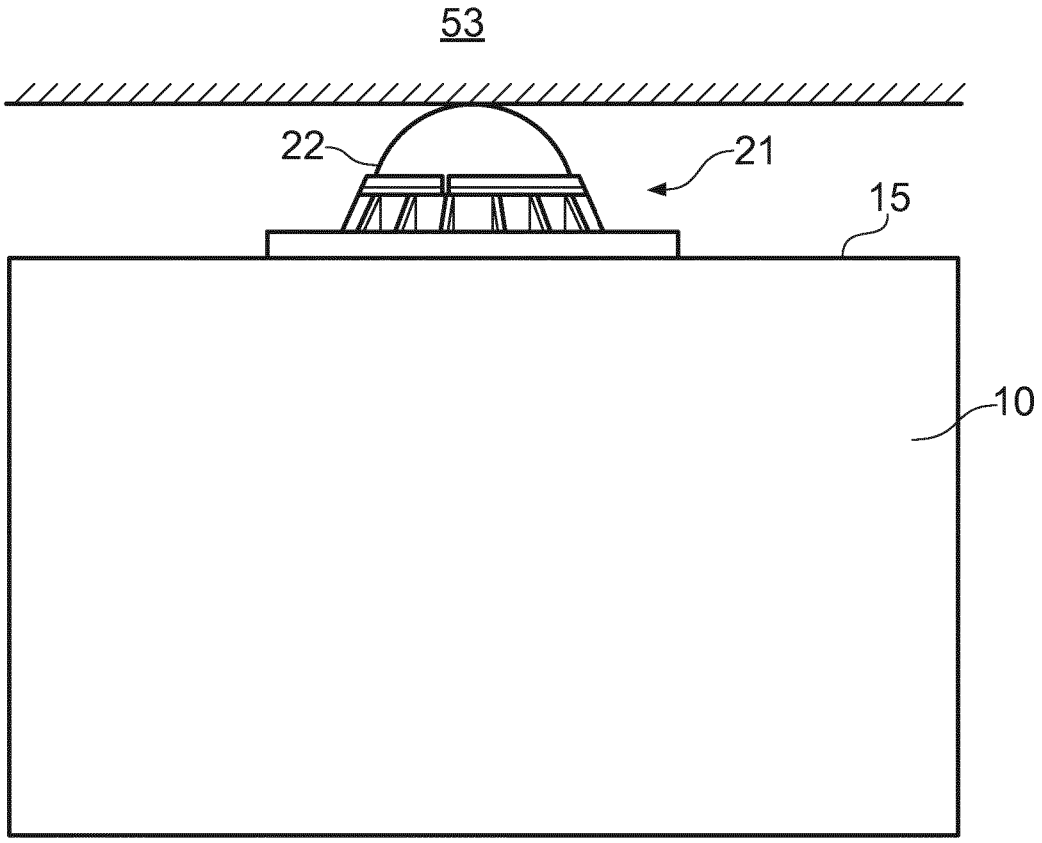
FIG. 4 shows an enlarged view of a portion of FIG. 2 where the upper wheel element is engaging the ceiling of a building.

In FIG. 2, the upper wheel elements 22 of the upper roller devices 21 are in their first position, i.e. they will be engaging the ceiling of the building. The upper locking members 23 are now in their second position where the locking members 23 are retracted and are not engaging the ceiling. The same will apply to the lower wheel elements 18 and the lower locking elements 19 of the lower roller devices 17. The upper wheel elements 22 and the lower wheel elements 18 are in firm contact with the ceiling and the floor respectively and the wall element 10 remains safely in its vertical position. In FIG. 4, an upper wheel element 22 is shown in detail in the first position. The upper wheel element 22 of the upper roller device 21 is extended and engages the ceiling 53. With the wheel elements 22, 18 and locking members 23, 19 in these positions, the wall element 10 is ready to move through the building.

To avoid the wheel elements 22, 18 of the upper roller devices 21 and the lower roller devices 17 from slipping when the wall element 10 is moving through a room of the building, the wheel elements 22, 18 of the upper roller devices 21 and the lower roller devices 17 are preferably covered with, or made of, a material that provides friction between the wheel elements and the ceiling and the floor. Typically such a material can be a rubber material.

Figure 5:
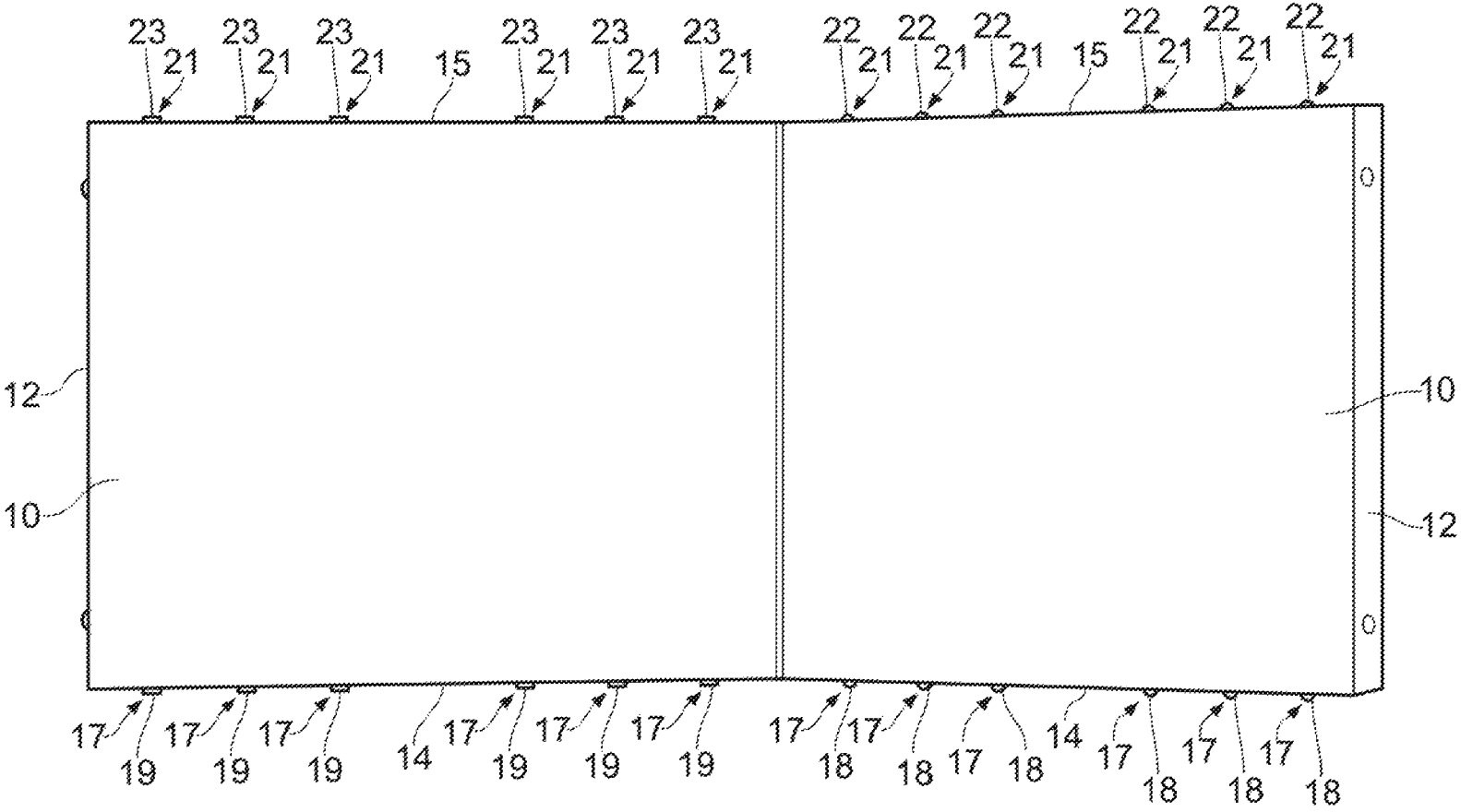
FIG. 5 is a side view of two wall elements that are connected to each other.
Figure 6:
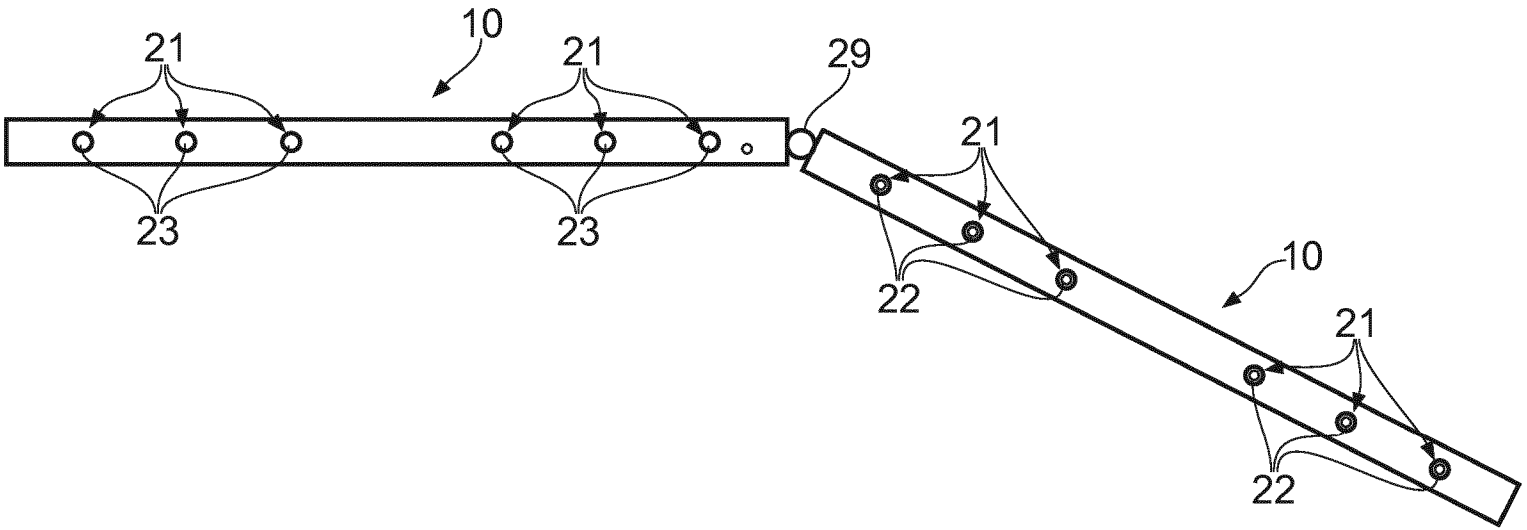
FIG. 6 is a top view of the two wall elements shown in FIG. 5.

FIGS. 5 and 6 show an example of a movable wall system comprising two wall elements 10 that are connected to each other with one or more connecting elements 29. In FIG. 5 the wall system is seen from the side and in FIG. 6 the wall system is seen from the top. The connecting element 29 is attached to the side faces 12 of the two wall elements 10 such that one wall element can rotate relative to the other wall element, for example by designing the connecting element 29 as a hinge-type element. In FIGS. 5 and 6 the upper roller devices 21 and lower roller devices 17 of the wall element 10 on the left side have their upper locking members 23 and lower locking members 19 respectively in their first positions where the locking members 23, 19 are engaging the ceiling and the floor respectively. The wall element 10 to the left is therefore not capable of moving. The upper roller devices 21 and lower roller devices 17 of the wall element 10 on the right side, on the other hand, have their upper locking members 23 and lower locking members 19 respectively in their second positions where the locking members 23, 19 are retracted and do not engage the ceiling or the floor, while the upper wheel elements 22 and the lower wheel elements 18 are in their first positions where the wheel elements 22, 18 are engaging the ceiling and the floor respectively. The wall element 10 on the right side is therefore capable of moving. However, since the wall elements are rotatably connected to each other through one or more connecting elements 29, the wall element 10 on the right side can only rotate relative to the wall element on the left side as indicated on the figures.

It should be noted that since the wall elements 10 or the wall system is operated without the physical support of any person, the wall elements should preferably be in contact with both the ceiling and the floor of room of the building where it is placed. As long as upper wheel elements 22 and/or upper locking elements 23 and lower wheel elements 18 and/or lower locking elements 19 are in firm contact with the ceiling and the floor of the room respectively, a wall element or a wall system will remain in its vertical position without any further support.

Referring again to FIG. 7, the roller device further comprises a control unit 49 and preferably a plurality of sensors 50, 51, 52 which are signally connected to the control unit 49. The control unit 49 preferably controls the motor or motors 39 that move the wheel element 40 in and out of the roller device 31, the motor or motors 41 that drives the wheel element in the roller device 31 and the motor or motors 36 that moves the locking device in and out of the roller device 31.

The wall element 10 is adapted for remote control and the roller devices are therefore provided with at least one sensor or antenna 50 which is capable of receiving and registering a wireless signal and communicating that signal to the control unit 49. The wireless signal may be transmitted from for example a remote control, a smartphone or a smart pad, a computer device, a joy stick device etc., or it may simply be a person activating and controlling the wall system by using his or her voice or by employing one or more particular movements with his or her body. Based on the signals received, the control unit 49 can cause the motors 35, 39, 41 to operate.

To enable the wall element 10 to move without external support, the roller device 31 are preferably provided with a number of sensors 52, such as a gyro sensor, that registers the wall element's position in space, for example any angle that the wall element 10 makes with a vertical plane. If the control unit 49 registers that the wall element 10 starts to incline, the motors 41 can drive the wheel elements 40 such that the wall element's inclination is compensated and the wall element is returned to its vertical position. The roller device 31 is can also be provided with sensors 51, for example arranged in the wheel element 40, which are capable of sensing the rotational speed of the wheel element and the direction of rotation of the wheel element. Based on feedback from the sensors 51, the control device 49 can calculate the position of the wall element 10 and adjust the movement of the wheel element 40 by controlling the motors 41.

Figure 8:
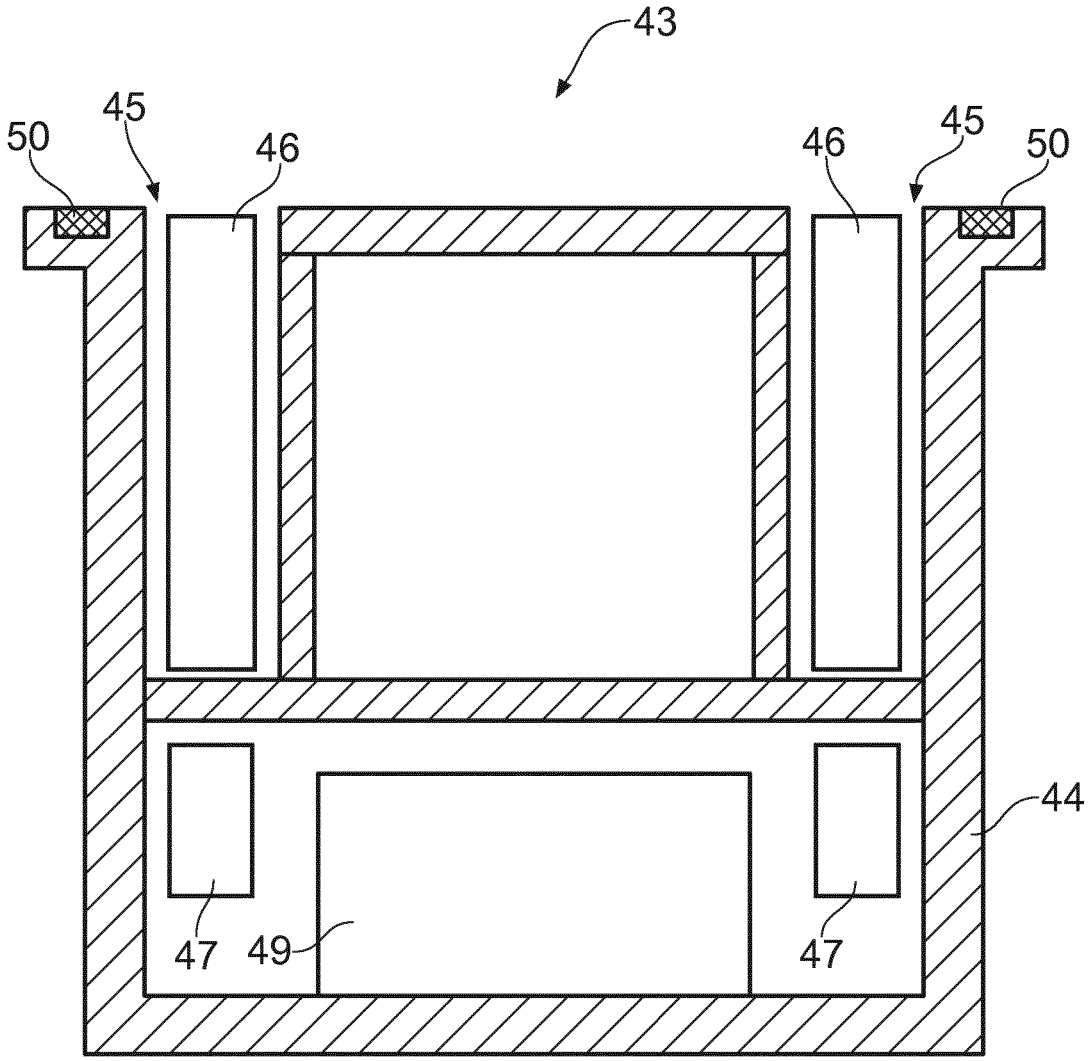
FIG. 8 illustrates a possible, general design of a separate locking device without a wheel element.

In FIGS. 1-7 there is shown a roller device which includes both a wheel element and a locking member. The locking member and the wheel element can, however, be provided in a separate locking devices. Referring to FIG. 8, there is shown such a separate locking device 43 which is not provided with a wheel element. The locking device 43 comprises a housing 44 which is provided with an annular space 45 in which an annularly shaped locking member 46 is movably positioned in the same way as described above. The locking member 46 is movable between a first position where the locking member extends out of the annular space 45 in the housing 44 making the locking member capable of engaging the ceiling or the floor of a building, and a second position (as shown in FIG. 7) where the locking member is retracted into the annular space 45 and incapable of engaging the ceiling or the floor. The locking device 43 is provided with one or more locking member motors 47, preferably an electric or electromagnetic motor, which are connected to or adapted to move the locking member 46 between its first position and second position.

The locking device 43 is also provided with at least one sensor or antenna 50 which is capable of receiving and registering a wireless signal and communicating that signal to the control unit 49. As mentioned above, the wireless signal may be transmitted from for example a remote control, a smartphone or a smart pad, a computer device, a joy stick device etc., or it may simply be a person activating and controlling the wall system by using his or her voice or by employing one or more particular movements with his or her body. Based on the signals received, the control unit 49 can cause the motors 47 to operate such that the locking member 46 moves in or out of the annular space 45 in the housing 44.

It should be mentioned that the wall elements 10 can be provided with windows and doors as required. Molding elements abutting the floor and ceiling can be fastened to the wall element or wall elements after they are in placed in a fixed position. Alternatively, the wall element or wall elements may be provided with upper and lower molding elements abutting the ceiling and floor respectively that are movably attached to the wall elements in a vertical direction such that the molding elements can be moved down from the ceiling and up from the floor when the wall elements are to be moved and such that the molding elements can be moved up towards and abutting the ceiling and down towards and abutting the floor when the wall elements have been moved to and fixed in their new positions. The molding elements may further be provided with a control unit and a sensor capable of receiving a wireless signal such that the movement of the molding elements can be effected in the same way as the movement of the wheel elements and the locking members as described above.

The invention has now been explained with reference to a non-limiting example. However, a person skilled in the art will appreciate that modifications and changes may be made to this embodiment which will be within the scope of the invention as defined in the following claims.

The invention claimed is:

1. A movable wall element configured to partition a room of a building with a floor and a ceiling into separate rooms, the movable wall element comprising:

at least one lower roller device comprising a wheel element which is capable of engaging the floor of the building when the movable wall element is to be freely moved across the floor; and at least one upper roller device comprising a wheel element which is capable of engaging the ceiling of the building when the movable wall element is to be freely moved across the floor, wherein the wheel element of the at least one upper roller device is movable between a first position where the wheel element of the at least one upper roller device is in engagement with the ceiling and a second position where the wheel element of the at least one upper roller device is retracted and not in engagement with the ceiling, and wherein the wheel element of the at least one lower roller device is movable between a first position where the wheel element of the at least one lower roller device is in engagement with the floor and a second position where the wheel element of the at least one lower roller device is retracted and not in engagement with the floor.

2. The movable wall element according to claim 1, wherein the at least one upper roller device further comprises at least one motor which is adapted to move the wheel element of the at least one upper roller device between the first and second positions thereof, and wherein the at least one lower roller device further comprises at least one motor which is adapted to move the wheel element of the at least one lower roller device between the first and second positions thereof.

3. The movable wall element according to claim 1, wherein the at least one upper roller device further comprises an upper locking member which is movable between a first position where the upper locking member is in engagement with the ceiling and a second position where the upper locking member is retracted and not in engagement with the ceiling, and wherein the at least one lower roller device further comprises a lower locking member which is movable between a first position where the lower locking member is in engagement with the floor and a second position where the lower locking member is retracted and not in engagement with the floor.

4. The movable wall element according to claim 3, wherein the at least one upper roller device further comprises at least one motor which is adapted to move the upper locking member between the first and second positions thereof, and wherein the at least one lower roller device further comprises at least one motor which is adapted to move the lower locking member between the first and second positions thereof.

5. The movable wall element according to claim 3, wherein the at least one upper roller device further comprises a single motor which is adapted to move: (i) the wheel element of the at least one upper roller device between the first and second positions thereof and (ii) the upper locking member between the first and second positions thereof, and wherein the at least one lower roller device further comprises a single motor which is adapted to move: (i) the wheel element of the at least one lower roller device between the first and second positions thereof, and (ii) the lower locking member between the first and second positions thereof.

6. The movable wall element according to claim 3, wherein the at least one upper roller device further comprises a first motor which is adapted to move the wheel element of the at least one upper roller device between the first and second positions thereof and a second motor which is adapted to move the upper locking member between the first and second positions thereof, and wherein the at least one lower roller device further comprises a first motor which is adapted to move the wheel element of the at least one lower roller device between the first and second positions thereof and a second motor which is adapted to move the lower locking member between the first and second positions thereof.

7. The movable wall element according to claim 1, wherein the at least one upper roller device further comprises at least one motor which is adapted to drive the wheel element of the at least one upper roller device, and wherein the at least one lower roller device further comprises at least one motor which is adapted to drive the wheel element of the at least one lower roller device.

8. The movable wall element according to claim 1, wherein the wheel element of the at least one lower roller device is fixed such that the wheel element of the at least one lower roller device is in engagement with the floor such that the movable wall element is capable of rolling on the floor.

9. The movable wall element according to claim 1, wherein the wheel element of the at least one upper roller device is lockable in the first position thereof where the wheel element of the at least one upper roller device is in engagement with the ceiling, and wherein the wheel element of the at least one lower roller device is lockable in the first position thereof where the wheel element of the at least one lower roller device is in engagement with the floor.

10. The movable wall element according to claim 1, wherein the movable wall element further comprises at least one locking device, the at least one locking device comprising a locking member for engagement with at least one of the ceiling and the floor, the locking member being movable between a first position where the locking member is in engagement with the at least one of the ceiling and the floor and a second position where the locking member is retracted and not in engagement with the at least one of the ceiling and the floor.

11. The movable wall element according to claim 10, wherein the at least one locking device further comprises a motor for movement of the locking member between the first and second positions thereof.

12. The movable wall element according to claim 1, wherein the movable wall element is a first movable wall element and further comprises a connecting element for connection to a second movable wall element.

13. The movable wall element according to claim 12, wherein the connecting element is adapted for a rotational movement between the first movable wall element and the second movable wall element.

14. The movable wall element according to claim 1, wherein the at least one upper roller device further comprises a control unit for controlling movement of the wheel element of the at least one upper roller device between the first and second positions thereof, and wherein the at least one lower roller device further comprises a control unit for controlling movement of the wheel element of the at least one lower roller device between the first and second positions thereof.

15. The movable wall element according to claim 14, wherein the at least one upper roller device further comprises a sensor for receiving a wireless control signal, the sensor of the at least one upper roller device being signally connected to the control unit of the at least one upper roller device, and wherein the at least one lower roller device further comprises a sensor for receiving a wireless control signal, the sensor of the at least one lower roller device being signally connected to the control unit of the at least one lower roller device.

16. A movable wall system comprising at least one movable wall element according to claim 1 and a sender device configured to send a wireless control signal to the at least one movable wall element.

17. The movable wall system according to claim 16, wherein the sender device is a remote control, a smartphone or a smart pad, a computer device, or a joy stick device.

18. The movable wall element according to claim 2, wherein the at least one motor of the at least one upper roller device is electric or electromagnetic, and wherein the at least one motor of the at least one lower roller device is electric or electromagnetic.

19. The movable wall element according to claim 7, wherein the at least one motor of the at least one upper roller device is electric or electromagnetic, and wherein the at least one motor of the at least one lower roller device is electric or electromagnetic.

20. The movable wall element according to claim 11, wherein the motor is electric or electromagnetic.

* * * * *